US005842805A

United States Patent [19]

Pierpont

[11] Patent Number: 5,842,805

[45] Date of Patent: Dec. 1, 1998

[54] COSMETIC CONTAINER HAVING A COOPERATING COSMETIC CARRIER AND INNER SLEEVE

[75] Inventor: Robert L. Pierpont, Meriden, Conn.

[73] Assignee: Rexam Cosmetic Packaging, Inc., Torrington, Conn.

[21] Appl. No.: 963,560

[22] Filed: Nov. 3, 1997

[51] Int. Cl.[6] ..... B43K 21/08

[52] U.S. Cl. ..... 401/78; 401/87

[58] Field of Search ..... 401/78, 87

[56] References Cited

U.S. PATENT DOCUMENTS

| | | | |
|---|---|---|---|
| 2,704,598 | 3/1955 | Casey | 401/78 |
| 3,298,509 | 1/1967 | Hultgren | 401/78 |
| 3,380,795 | 4/1968 | Gruska | 401/78 |
| 3,547,551 | 12/1970 | Gruska | 401/78 |
| 4,514,102 | 4/1985 | Ackerman et al. | 401/78 |
| 4,690,578 | 9/1987 | Idec et al. | 401/78 |
| 5,186,561 | 2/1993 | Ackermann et al. | 401/78 |
| 5,340,225 | 8/1994 | Chevassus | 401/78 |
| 5,597,252 | 1/1997 | Ito et al. | 401/78 |

FOREIGN PATENT DOCUMENTS 2 426 427 12/1979 France .

*Primary Examiner*—Robert M. Fetsuga
*Assistant Examiner*—Tuan N. Nguyen
*Attorney, Agent, or Firm*—Bell Seltzer Intellectual Property Law Group of Alston & Bird LLP

[57] ABSTRACT

A cosmetic container having an inner sleeve and cosmetic carrier which cooperate to provide requisite torque and prevent angular movement therebetween. The cosmetic carrier includes a plurality of radially outwardly extending, vertical ribs and the inner sleeve includes a plurality of radially inwardly extending, vertical ribs. The cosmetic carrier is positioned within the inner sleeve wherein the ribs of one member cooperate with the ribs of the other. When the inner sleeve is rotated so as to extend or retract the cosmetic carrier, the inwardly extending ribs of the inner sleeve engage the outwardly extending ribs of the cosmetic carrier. When the cosmetic carrier is fully extended or fully retracted, the inwardly extending ribs of the inner sleeve and the outwardly extending ribs of the carrier are disengaged.

20 Claims, 5 Drawing Sheets

COSMETIC CONTAINER HAVING A COOPERATING COSMETIC CARRIER AND INNER SLEEVE

FIELD OF THE INVENTION

The present invention is directed to a cosmetic container and, more specifically, to a cosmetic carrier and an inner sleeve having enhanced torque therebetween and for limiting, if not preventing, angular movement therebetween.

BACKGROUND OF THE INVENTION

Conventional lipstick containers include a cosmetic carrier, a tubular inner sleeve, a tubular outer sleeve and a decorative sleeve. The cosmetic carrier supports the lipstick and is generally configured as a sleeve having radially extending lugs on opposing sides and is received within the inner sleeve. The inner sleeve defines longitudinally extending slots on opposing sides wherein the lugs of the cosmetic carrier extend therethrough. An outer sleeve defining a continuous helical channel is positioned about the inner sleeve wherein the lugs of the cosmetic carrier are configured to be received within and to traverse along the length of the helical channel. This results in the cosmetic carrier being moved upwardly as the lugs traverse the length of the helical channel when a bottom portion of the inner sleeve is rotated. The decorative outermost sleeve is provided for aesthetic purposes. In operation, a bottom portion of the inner sleeve extends beyond the bottom of the outer decorative sleeve. The user rotates the bottom portion to cause the cosmetic carrier and, hence, the lipstick to extend from the case for applying the lipstick and to retract into the case for storage.

A high quality lipstick container has a certain "feel" to it, i.e., rotating freely yet having enough resistance or torque to be sturdy. A desirable feature of cosmetic containers is that constant torque, i.e., having minimal or no noticeable changes in torque, may be applied to extend and retract the cosmetic housed within the container. It is also desirable to prevent angular movement of the cosmetic carrier relative to the inner sleeve. Angular movement of the cosmetic carrier may damage the pomade or lipstick within the cosmetic carrier as it contacts the inner surface of the inner sleeve. Thus, obtaining the desirable amount of torque and obviating relative angular movement between the cosmetic carrier and the inner sleeve provides a desirably smooth and uniformly operating cosmetic container.

Prior art attempts of providing increased torque to cosmetic containers include providing an interference between the cosmetic carrier and the inner sleeve. Such cosmetic containers may provide the requisite torque, but do so in a manner which requires exact tolerance, are relatively expensive to manufacture, and experience wear over extended use thereby adversely effecting torque produced between the relatively rotating sleeves. Further, many such cosmetic containers have features directed to achieving the desired amount of torque, but cosmetic containers must be able to achieve the desired torque consistently and repeatedly while simultaneously preventing angular movement of the cosmetic carrier relative to the inner sleeve.

SUMMARY OF THE INVENTION

It is an object of the present invention to provide a cosmetic container having enhanced swivel torque while preventing angular movement of the cosmetic carrier relative to the inner sleeve.

It is another object of the present invention to do so in a consistent, repeatable manner.

The present invention pertains to a cosmetic container and, more specifically, to the combination of the cosmetic container's inner sleeve and cosmetic carrier. This combination provides the desired amount of uniform torque and prevents angular movement of the carrier relative to the inner sleeve, thereby protecting the pomade or lipstick housed therein. Another benefit of the disclosed invention is that the cosmetic carrier may be locked relative to the inner sleeve at its fully extended and fully retracted positions without a noticeable change in torque, which often results in an undesirable "clicking " sound.

This is achieved by the instant invention including a cosmetic carrier having a plurality of radially outwardly extending, vertical ribs and an inner sleeve including a plurality of radially inwardly extending, vertical ribs. Preferably both the cosmetic carrier and the inner sleeve are formed of a plastic resin wherein the respective ribs of each are integrally formed therewith. Thus, the ribs possess an inherent degree of flexibility. The cosmetic carrier is positioned within the inner sleeve wherein the ribs of one member cooperate with the ribs of the other. Preferably, the cosmetic carrier includes two pairs, or four, radially outwardly extending ribs which extend substantially the vertical length of the cosmetic carrier and parallel to the longitudinal axis thereof. The inner sleeve preferably includes two pairs, or four, vertical ribs extending radially inwardly.

The inner sleeve includes an upper tubular portion having a first diameter and a lower tubular portion having a second, greater diameter wherein the longitudinal slots are defined by the upper portion. The inwardly extending ribs of the inner sleeve extend vertically substantially the length of the longitudinal slots. The thickness of the ribs of the inner sleeve, as measured circumferentially, is substantially less than the thickness of the ribs of the cosmetic carrier, also measured circumferentially.

On the upper and lower ends of the longitudinal slots are locking channels which are defined by channels extending perpendicular to each of the longitudinal slots. The locking channels on the upper end extend horizontally in a direction opposite from the lower locking channels. Thus, when the cosmetic carrier is positioned within the inner sleeve, the lugs of the carrier extend through the longitudinal slots and, upon rotation of the base in one direction, the lugs of the cosmetic carrier traverse the length of the helical channel of the outer sleeve and the longitudinal slot of the inner sleeve so as to extend the lipstick for application. Upon reaching the upper locking channel, the cosmetic carrier is prevented from further rotational movement. Similarly, when the inner sleeve is rotated in the opposite direction, the cosmetic carrier is confined at its fully retracted position by the lower locking channel.

In an unlocked position, i.e., when the inner sleeve is rotated so as to extend or retract the cosmetic carrier, the inwardly extending ribs of the inner sleeve are in contact with the outwardly extending ribs of the cosmetic carrier. This thus provides the requisite torque and prevents angular movement of the cosmetic carrier relative to the inner sleeve, thereby protecting the pomade contained therein. When the cosmetic carrier is fully extended or fully retracted, the lug of the cosmetic carrier is positioned within the respective one of the locking channels. In this position, the inwardly extending ribs of the inner sleeve and the outwardly extending ribs of the carrier are not in alignment and, therefore, the members are disengaged, i.e, the ribs of the inner sleeve are positioned between adjacent ribs of the cosmetic carrier. This position will be assumed until the requisite force is applied to the base of the cosmetic carrier, thereby rotating the inner sleeve so that the ribs of the inner sleeve and the ribs of the cosmetic carrier again engage one another. Noticeable change in torque as the carrier approaches the fully extended or fully retracted positions is minimized, if not obviated, by the mating ribs of the cosmetic carrier and inner sleeve.

BRIEF DESCRIPTION OF THE DRAWINGS

The foregoing and other objects, features, and advantages of the present invention will be made apparent from the following detailed description of the preferred embodiment of the invention and from the drawings, in which.

DETAILED DESCRIPTION OF THE PREFERRED EMBODIMENTS

The present invention will now be described more fully in detail with reference to the accompanying drawings, in which a preferred embodiment of the invention is shown. This invention should not, however, be construed as limited to the embodiment set forth herein; rather, it is provided so that this disclosure will be thorough and complete and will fully convey the scope of the invention to those skilled in the art.

The present invention as shown and described herein is a container for applying cosmetics, such as lipstick. However, it should be evident that the container has utility in various other areas wherein a product is to be extended from and retracted into a case. For instance, the container may be utilized for any product requiring topical application.

Figure 1:
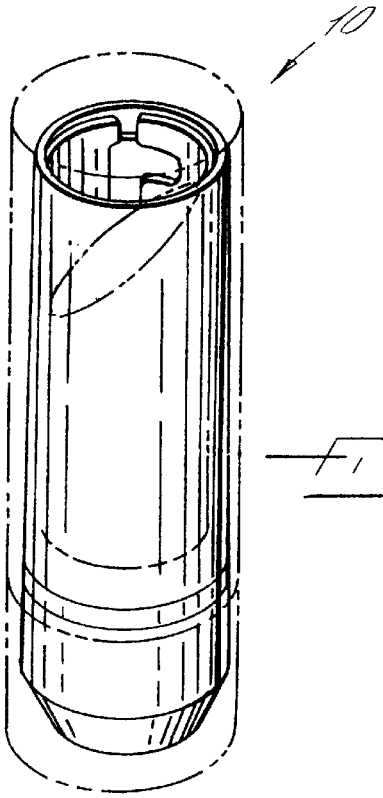
FIG. 1 is a perspective view of a cosmetic container according to the present invention.
Figure 2:
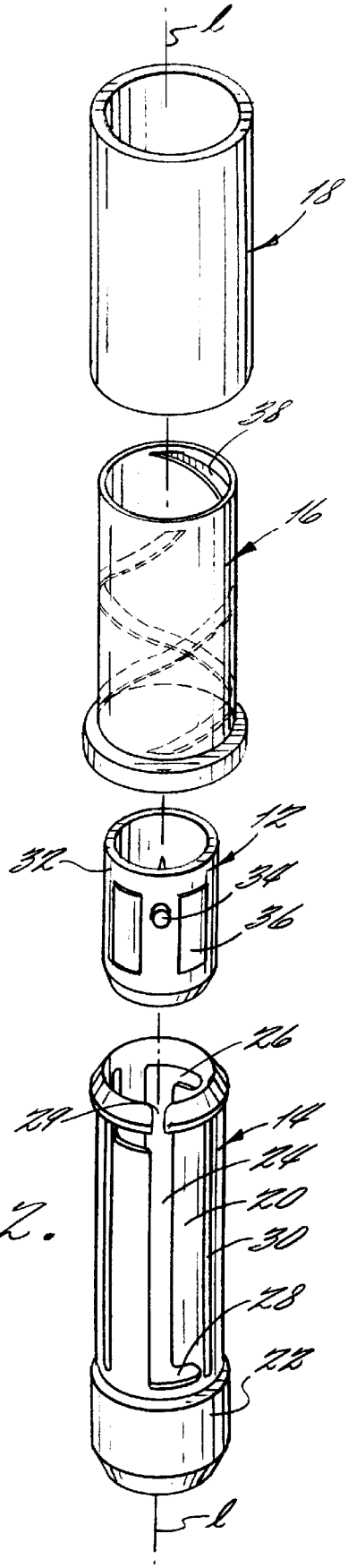
FIG. 2 is an exploded view thereof.

The lipstick container of the present invention, indicated generally by the reference character 10, is designed for dispensing lipstick so that it may be cosmetically applied. The cosmetic container 10 includes a plurality of concentrically arranged tubular members, which members are shown in an exploded fashion in FIG. 2. The various members are concentrically arranged about the longitudinal axis l. Starting from the inside, the cosmetic container 10 includes a cosmetic carrier 12, a first tubular inner sleeve 14, a second tubular outer sleeve 16 and a decorative sleeve 18. The resulting product containing the cosmetic container typically also includes a base shell and a top shell as shown in phantom in FIG. 1.

The inner sleeve 14 includes an upper tubular portion 20 having a first diameter and a lower tubular portion 22 having a second diameter wherein the second diameter is greater than the first diameter. The upper tubular portion 20 defines at least one, and preferably a pair, of diametrically opposed longitudinal slots 24. The longitudinal slots 24 extend parallel to longitudinal axis l of the cosmetic container 10.

An upper locking channel 26 extends perpendicular to the longitudinal slot 24. Similarly, a lower locking channel 28 extends perpendicular to the longitudinal slot 24 in a direction opposite the upper locking channel 26 as described in more detail below. An integral opening 29 is provided along the upper end of the longitudinal slot 24 of the tubular inner sleeve 14 for positioning the cosmetic carrier 12 within the inner sleeve 14. The inner sleeve 14 also includes at least one, and preferably a pair or more of ribs 30 which extend longitudinally along the upper tubular portion 20 of the inner sleeve 14, parallel to the longitudinal axis l. As illustrated, the inner sleeve 14 includes at least two pairs of vertical ribs 30. The vertical ribs 30 extend radially inward from the upper tubular portion 20 and are preferably integrally molded therewith. As used herein, "vertical ribs" refers to ribs which extend along a portion of the length of the inner sleeve, irrespective of the width of the ribs; the width being measured circumferentially. Thus, as used herein, even a rib which is wider, measured circumferentially, than it is long, measured along the length of the inner sleeve, nonetheless falls within the definition of a "vertical rib". The same terminology is applied in the description to follow regarding the vertical ribs 36 of the cosmetic carrier 12.

Figure 3:
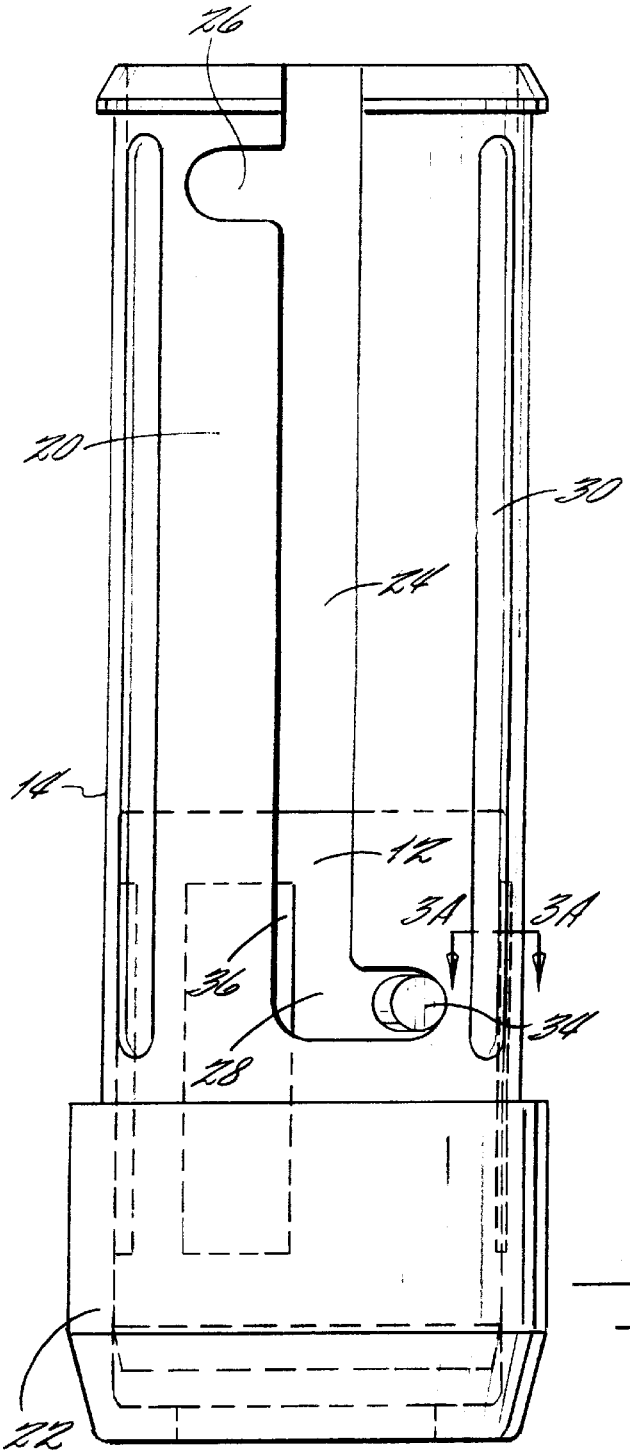
FIG. 3 is a front elevational view of the inner sleeve and cosmetic carrier according to the present invention wherein the cosmetic carrier is fully retracted.
Figure 4:
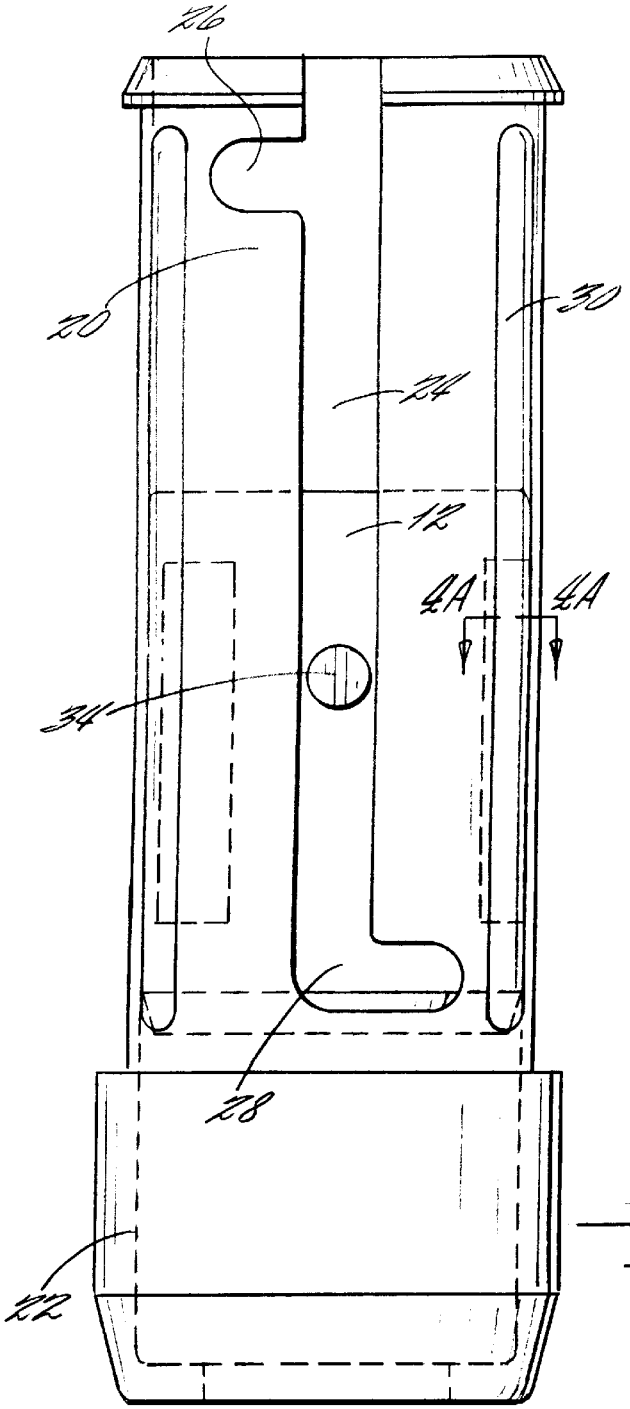
FIG. 4 is a front elevational view of the inner sleeve and cosmetic carrier according to the present invention wherein the cosmetic carrier is partially extended.
Figure 5:
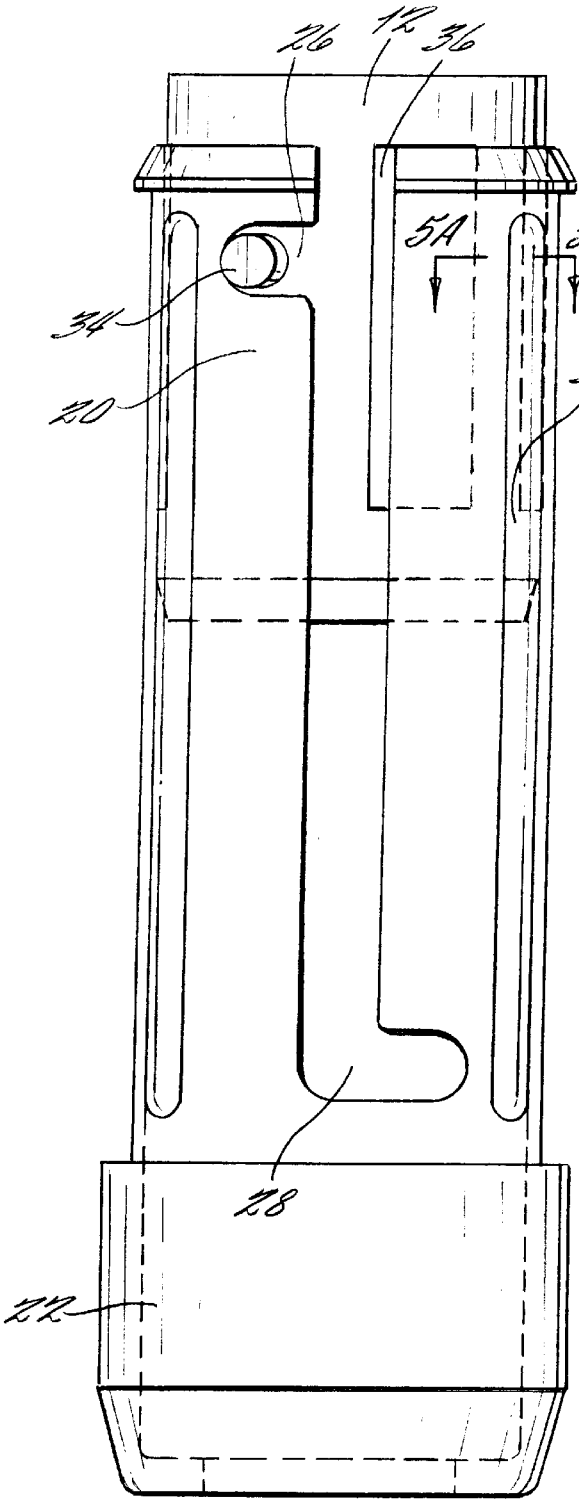
FIG. 5 is a front elevational view of the inner sleeve and cosmetic carrier according to the present invention wherein the cosmetic carrier is in a fully extended position.

Preferably, the inner sleeve 14 is formed of a plastic material and, therefore, the vertical ribs 30 are inherently flexible. As best illustrated in FIGS. 3 through 5, the vertical ribs 30 extend along a portion of the length of the inner sleeve 14, and preferably substantially along at least a quarter of the length of the upper tubular portion 20, e.g., at least along half of the length of the upper tubular portion 20 of the inner sleeve 14.

The cosmetic carrier 12 is defined by an annular sidewall 32 which includes at least one, and preferably a pair of diametrically opposed, radially outwardly extending lugs 34. The sidewall 32 also includes at least one and preferably a plurality of radially outwardly extending vertical ribs 36. When assembled, the cosmetic carrier 12 is positioned concentrically within the tubular inner sleeve 14 as best illustrated in FIGS. 3 through 6. As such, the carrier lugs 34 extend through the longitudinal slot 24 for retraction and extension of the lipstick within the cosmetic carrier 12. The vertical ribs 36 of the cosmetic carrier 12 may extend along any length of the sidewall 32. According to a preferred embodiment, however, the vertical ribs extend at least along a quarter of the length of the cosmetic carrier sidewall 32, e.g., at least along half of the length thereof.

The tubular inner sleeve 14 is positioned concentrically within a tubular outer sleeve 16 which defines at least one helical channel 38. The helical channel 38 is configured so as to receive at least a portion of the radially outwardly extending lugs 34 extending from the cosmetic carrier 12. The decorative outer sleeve 18 is then positioned about the tubular outer sleeve 16 for aesthetic purposes.

Accordingly, the cosmetic carrier 12, positioned within in the tubular inner sleeve 14, is movable longitudinally upwardly and downwardly within the inner sleeve 14. The longitudinal slots 24 permit the lugs 34 of the cosmetic carrier 12 to extend therethrough. The lower tubular portion 22, when assembled with the other members of the cosmetic container 10, provides a manually rotatable base portion.

The operation of the cosmetic container 10 according to the present invention will now be described with reference to the various figures. The cosmetic container extends and retracts the lipstick so that it may be applied. The lipstick is propelled within and from the cosmetic container 10 by removal of the shell cover (shown in phantom FIG. 1) and by rotation of the lower tubular portion 22 of the inner sleeve 14 relative to the outer sleeve 16. In an alternative embodiment, the lower tubular portion 22 may be secured to a shell base (shown in phantom and FIG. 1) wherein, when the shell base is rotated, the inner sleeve 14 secured thereto also rotates. Accordingly, rotating the shell base with the lower tubular portion 22 in a predetermined direction causes the cosmetic carrier 12 retained therein to rotate. This is achieved due to the extension of the lugs 34 through the longitudinal slots 24 which would, inherently, abut a respective longitudinal side edge defining the longitudinal slot 24 (depending upon the direction of rotation). Because the lugs 34 are also received, or a least a portion thereof, within the helical channel 38 of the tubular outer sleeve 16, the lugs 34 of the cosmetic carrier 12 traverse the length of the helical channel 38 wherein the carrier 12 is moved upward or downward within the longitudinal slots 24.

At each of the upper and lower ends of the longitudinal slot 24 are provided laterally extending locking channels 26 and 28 which, as shown, are formed integrally with the longitudinal slots 24. The locking channels 26 and 28 limit the movement of the cosmetic carrier 12 so that when the cosmetic carrier 12 reaches the uppermost position, for example, it is restrained from further upward movement because further rotatable movement of the lower tubular portion 22 of the inner sleeve 14 is prohibited. Likewise, when the lipstick within the cosmetic carrier 12 is fully retracted, further retraction is prohibited due to the retention of the lug 34 within the lower laterally extending locking channel 28 of the longitudinal slot 24. Thus, the lipstick may be extended by rotating the lower tubular portion 22 in one direction, and retracted by rotating the lower tubular portion 22 in the opposite direction to permit easy application while protecting the lipstick within the cosmetic container when its not in use.

Figure 3A:
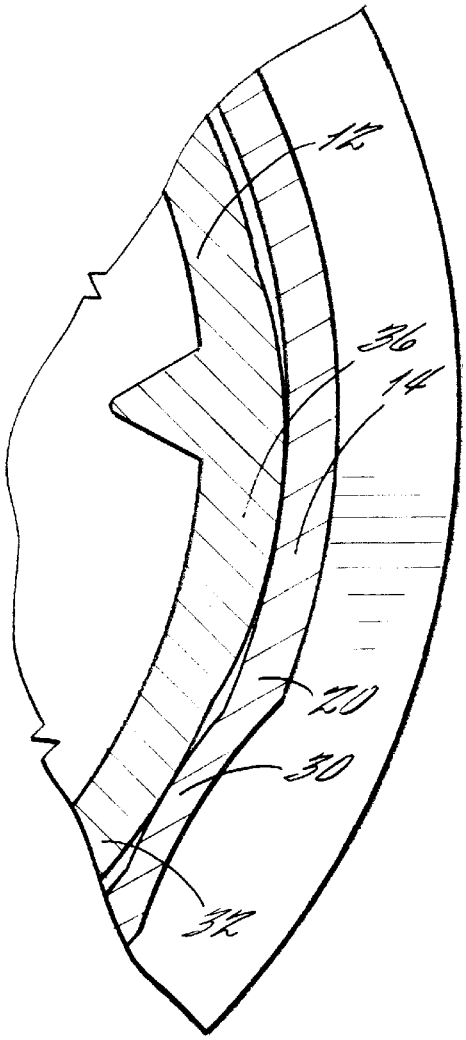
FIG. 3A is an enlarged cross-sectional view taken along lines 3A—3A of FIG. 3.

Increased torque results, at least in part, by the combination of the radially inwardly extending vertical ribs 30 of the inner sleeve 14 which cooperate with the radially outwardly extending vertical ribs 36 of the cosmetic carrier 12 as described in more detail with particular reference to FIGS. 3 through 5. FIG. 3 represents the cosmetic container 10 in a fully retracted position wherein the radially outwardly extending lugs 34 of the cosmetic carrier 12 are received within the lower locking channels 28. In this position, the cosmetic carrier ribs 36 are disengaged from the tubular inner sleeve vertical ribs 30 as best illustrated in FIG. 3A.

Figure 4A:
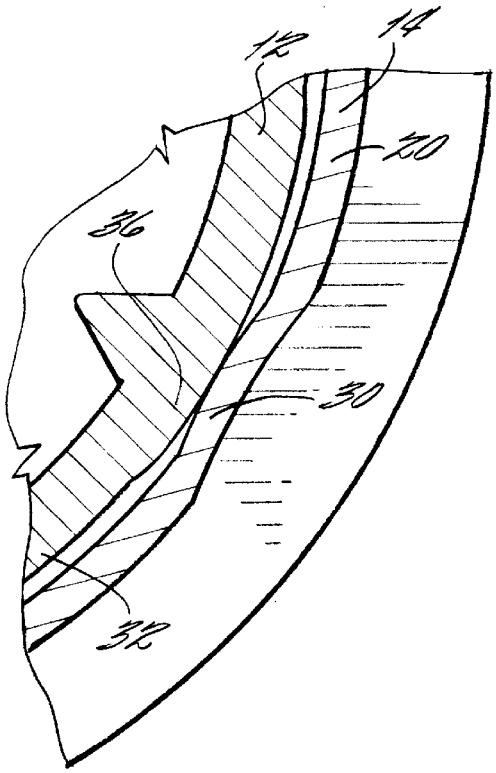
FIG. 4A is an enlarged cross-sectional view taken along line 4A—4A of FIG. 4.

As rotational force is applied to the lower tubular portion 22, the inner sleeve 14 rotates in a predetermined direction, causing the cosmetic carrier 12 to traverse the length of longitudinal slot 24, as illustrated in FIG. 4, as the lugs 34 simultaneously traverse the length of the helical channel 38 of the tubular outer sleeve 16. Between the fully extended and the fully retracted position, the cosmetic carrier vertical ribs 36 engage the inner sleeve vertical ribs 30 as best illustrated in FIG. 4A. This provides an interference between the concentrically arranged tubular members thereby creating torque and preventing relative angular movement therebetween. Preferably, the outer diameter of the cosmetic carrier 12, defined between outermost surfaces of the vertical ribs 36, is at least equal to, e.g., greater than, the inner diameter of the inner sleeve 14, defined between innermost surfaces of the vertical ribs 30. Thus, due to the preferred inherent flexibility of the vertical ribs 30 and 36, interference occurs resulting in the desired amount of swivel torque. This also limits or prevents relative angular movement and provides for smoothly operating locking functions when the carrier lugs 34 are in the fully extended or retracted position.

Figure 5A:
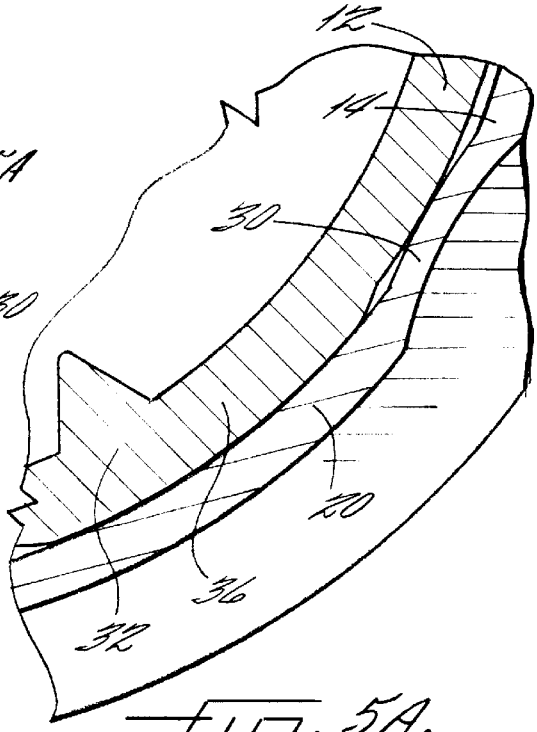
FIG. 5A is an enlarged cross-sectional view taken along lines 5A—5A of FIG. 5.

When the cosmetic carrier 12 is fully extended, the cosmetic carrier lugs 34 are received within the upper locking channel 26 as illustrated in FIG. 5. In the fully extended position, the cosmetic carrier vertical ribs 36 and the inner sleeve vertical ribs 30 are again in a disengaged position as represented by FIG. 5A.

Figure 6A:
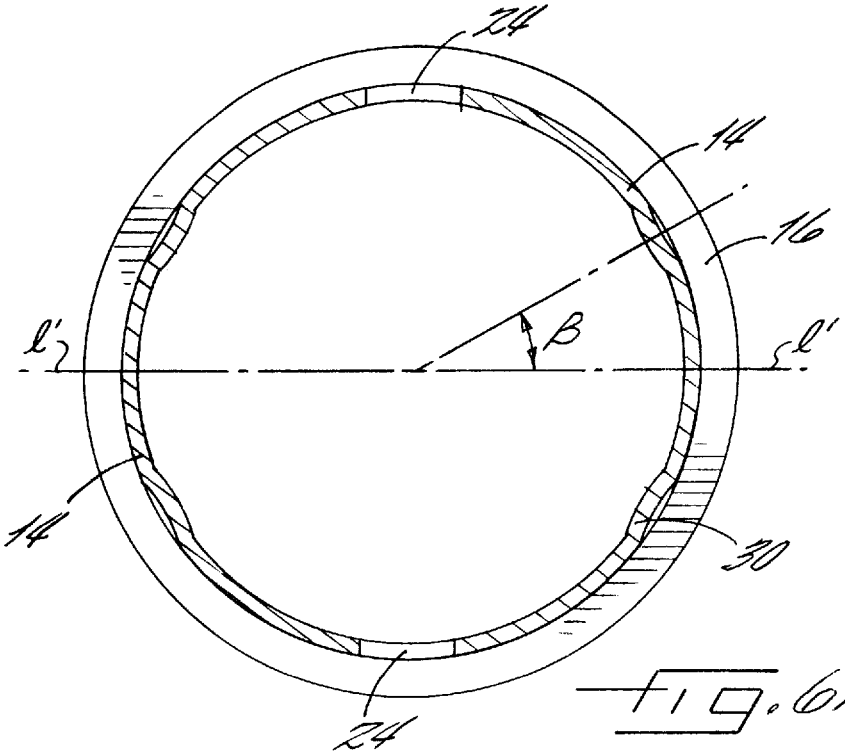
FIGS. 6A and 6B are top, cross-sectional views of the inner sleeve and the cosmetic carrier, respectively, according to the present invention.
Figure 6B:
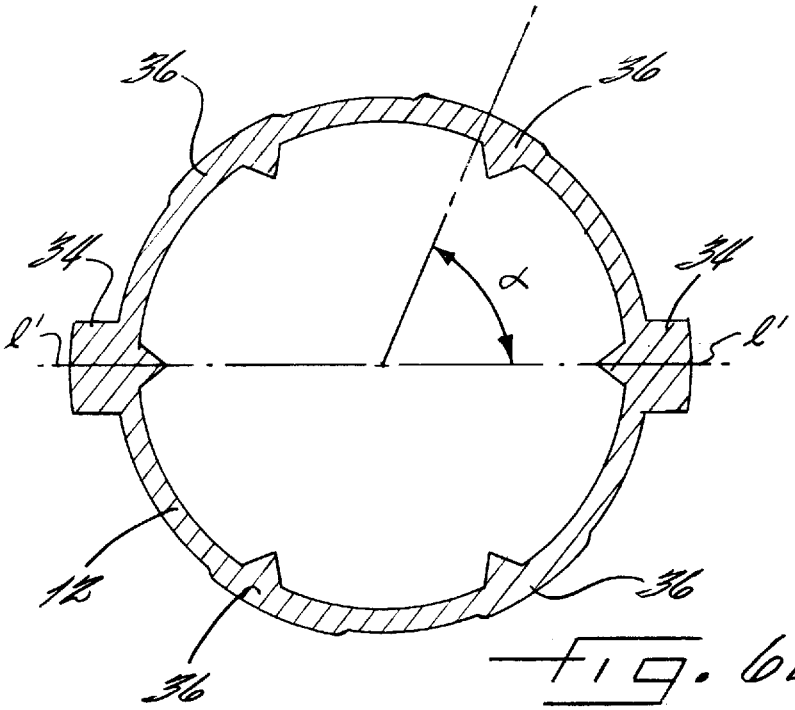

Preferably, at least two pairs of ribs, both on the cosmetic carrier 12 and the tubular inner sleeve 14, are provided as represented in FIGS. 6A and 6B. As illustrated, therefore, two pairs of ribs 30 and 36 are provided on each the cosmetic carrier 12 and inner sleeve 14. The width of the ribs 36 of the carrier 12, as measured circumferentially, are greater than the width of the ribs 30 of the inner sleeve 14. In the embodiment illustrated in FIG. 6B, the center of the ribs 36 of the cosmetic carrier 12 are each positioned at an angle $\alpha$ which is at least 45° from a lateral axis l' extending across the centers of the carrier lugs 34, perpendicular to the longitudinal axis l. According to a preferred embodiment, $\alpha$ is about 53° from the lateral axis l' and the ribs 30 extend circumferentially about 10° along the circumference of the carrier 12. The center of the ribs 30 of the inner sleeve 14, as illustrated in FIG. 6A, are each positioned at an angle $\beta$ which is at least 20°, such as 30°, from the lateral axis l' which extends across the center of the longitudinal slots 24.

While particular embodiments of the invention have been described, it will be understood, of course, that the invention is not limited thereto since modifications may be made by those skilled in the art, particularly in light of the foregoing teachings. It is therefore contemplated by the appended claims to cover any such modifications that incorporate those features or these improvements in the true spirit and scope of the invention.

That which is claimed:

1. A cosmetic container for dispensing a cosmetic comprising:

a first tubular sleeve having at least one rib extending radially inward;

a cosmetic carrier having an annular sidewall concentrically positioned within said first tubular sleeve and being movable therein along the longitudinal axis of said first tubular sleeve between a substantially fully extended and a substantially fully retracted position defining an unlocked position therebetween, and having at least one rib extending radially outward from said sidewall and configured to mate with said rib of said tubular sleeve when said carrier is positioned within said first sleeve in said unlocked position between said substantially fully extended and substantially fully retracted positions.

2. A cosmetic container according to claim 1 wherein said rib of said cosmetic carrier is a vertical rib which extends along a length of said annular sidewall parallel to the longitudinal axis thereof.

3. A cosmetic container according to claim 2 wherein said rib of said first sleeve is a vertical rib which extends along a length of said tubular sleeve parallel to the longitudinal axis thereof.

4. A cosmetic container according to claim 3 wherein said first sleeve includes at least a pair of said ribs positioned on opposing sidewalls thereof.

5. A cosmetic container according to claim 4 wherein said first sleeve includes at least two pairs of said ribs with each rib of said pairs being positioned on diametrically opposing sidewalls thereof.

6. A cosmetic container according to claim 3 wherein said at least one vertically extending rib of said cosmetic carrier and said at least one vertically extending rib of said first sleeve extend a circumferential width transverse to the longitudinal axis of said cosmetic carrier and said width of said cosmetic carrier rib is greater than said width of said first sleeve rib.

7. A cosmetic container according to claim 3 wherein said at least one vertically inwardly extending rib of said first tubular sleeve and a diametrically opposing sidewall of said first sleeve defines an inner diameter which is at least equal to an outer diameter of said cosmetic carrier defined by said vertically outwardly extending rib of said carrier and a diametrically opposing sidewall thereof.

8. A cosmetic container according to claim 7 wherein said outer diameter of said cosmetic carrier is greater than said inner diameter of said first tubular sleeve.

9. A cosmetic container according to claim 2 wherein said first sleeve is defined by an upper tubular portion having a first diameter and a lower tubular portion having a second diameter greater than said first diameter and said vertically extending rib of said first sleeve extends substantially along at least a quarter of the length of said upper tubular portion.

10. A cosmetic container according to claim 9 wherein said vertically extending rib of said first sleeve extends substantially along at least half of the length of said upper tubular portion.

11. A cosmetic container according to claim 2 wherein said vertically extending rib of said cosmetic carrier extends substantially along at least a quarter of the length of said cosmetic carrier.

12. A cosmetic container according to claim 11 wherein said vertically extending rib of said cosmetic carrier extends substantially along at least half of the length of said cosmetic carrier.

13. A cosmetic container according to claim 2 wherein said cosmetic carrier includes at least a pair of said ribs positioned on opposing sidewalls thereof.

14. A cosmetic container according to claim 13 wherein said cosmetic carrier includes at least two pairs of said ribs with each rib of said pairs being positioned on diametrically opposing sidewalls thereof.

15. A cosmetic container according to claim 14 wherein said cosmetic carrier includes a second, lateral axis extending perpendicular to said longitudinal axis wherein each of said ribs of said at least two pairs of ribs are positioned with a center located more than 45° (degrees) from the lateral axis.

16. A cosmetic container according to claim 14 wherein said inner sleeve has a second, lateral axis perpendicular to said longitudinal axis wherein each of said ribs of said at least two pairs of ribs are positioned with a center located more than 20° (degrees) from the lateral axis.

17. A cosmetic container according to claim 1 further comprising an outer tubular sleeve positioned concentrically about said first tubular sleeve, said outer tubular sleeve including a helical channel extending along an inner periphery thereof.

18. A cosmetic container according to claim 17 wherein said first tubular sleeve includes at least one slot extending longitudinally along at least a substantial portion of its length, and wherein said cosmetic carrier includes at least one radially, outwardly extending lug extending through said slot and into said helical channel so that upon rotation of said first tubular sleeve relative to said outer sleeve, said lug traverses the length of said helical channel and said slot so that the cosmetic carrier may be extended and retracted.

19. The cosmetic container according to claim 18 wherein said one rib of said first tubular sleeve and said one rib of said carrier are positioned to be in engagement with each other during extension and retraction of said carrier.

20. A cosmetic container according to claim 1 wherein said at least one rib of said carrier does not engage said at least one rib of said first tubular sleeve in said substantially fully extended and retracted positions.

* * * * *

UNITED STATES PATENT AND TRADEMARK OFFICE

CERTIFICATE OF CORRECTION

PATENT NO. : 5,842,805
DATED : December 1, 1998
INVENTOR(S) : Pierpont

It is certified that error appears in the above-identified patent and that said Letters Patent is hereby corrected as shown below:

Title page,
Item [56], References Cited, FOREIGN PATENT DOCUMENTS, insert:
-- 361096 5/1962 Switzerland --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*